US011274901B2

(12) United States Patent
Burgess

(10) Patent No.: US 11,274,901 B2
(45) Date of Patent: Mar. 15, 2022

(54) MODULAR WEAPON FOREGRIP

(71) Applicant: Joshua K. Burgess, Spring, TX (US)

(72) Inventor: Joshua K. Burgess, Spring, TX (US)

( * ) Notice: Subject to any disclaimer, the term of this patent is extended or adjusted under 35 U.S.C. 154(b) by 0 days.

(21) Appl. No.: 16/886,968

(22) Filed: May 29, 2020

(65) Prior Publication Data

US 2021/0372732 A1 Dec. 2, 2021

(51) Int. Cl.
*F41C 23/16* (2006.01)
*F41C 23/10* (2006.01)
*F41G 1/35* (2006.01)

(52) U.S. Cl.
CPC ..... *F41C 23/16* (2013.01); *F41G 1/35* (2013.01)

(58) Field of Classification Search
CPC ..... F41C 23/12; F41C 23/14; F41C 23/16; F41C 23/00; F41A 11/02; F41A 35/00; F41A 35/06
See application file for complete search history.

(56) References Cited

U.S. PATENT DOCUMENTS 2,104,129 A * 1/1938 Kress ..... F41C 23/16 42/71.01
2,669,051 A * 2/1954 Cline ..... F41C 23/14 42/71.01
3,683,538 A * 8/1972 Locatelli ..... F41C 23/08 42/74
3,739,167 A * 6/1973 Avery ..... F41G 1/467 362/157
4,122,623 A * 10/1978 Stice ..... F41C 23/14 42/73
6,622,416 B2 * 9/2003 Kim ..... F41G 1/35 362/110
7,340,857 B1 * 3/2008 Bentley ..... F41A 25/10 42/1.06
7,441,918 B2 * 10/2008 Kim ..... F41G 1/34 200/18
7,587,852 B1 * 9/2009 Harms ..... F41C 23/10 42/71.02
7,827,726 B2 * 11/2010 Stokes ..... F41H 13/0056 42/146
7,845,105 B1 * 12/2010 Cahill ..... F41C 27/00 42/72
8,117,782 B2 * 2/2012 Gross ..... F41G 11/003 42/146
8,438,769 B1 * 5/2013 Ghannam ..... F41C 23/16 42/71.01
D728,054 S * 4/2015 Webber ..... D22/108
9,062,933 B1 * 6/2015 Allen ..... F21V 21/34
(Continued)

*Primary Examiner* — Derrick R Morgan
(74) *Attorney, Agent, or Firm* — Crump Law P.C.

(57) ABSTRACT

The weapon foregrip uses a modular design that includes a grip base and interchangeable angled grip attachments. The interchangeable angle grip attachments have bottom grip faces with differing grip angles, which allows the configuration of the foregrip to be selectively adapted for the particular user and weapon. The grip base has a grip body and an integral forward extending switch platform, which properly positions a pressure switch under the user's thumb so that an illumination and/or targeting device can be actuated by the user's thumb while maintaining a positive "thumb-forward" grip on the weapon. The foregrip may also have an electronics head, which houses integrated electronic illumination and/or targeting systems.

20 Claims, 16 Drawing Sheets

(56) References Cited

U.S. PATENT DOCUMENTS

D745,623 S * 12/2015 Flores ..... D22/108
9,709,358 B2 * 7/2017 Kincel ..... F41C 23/16
D803,971 S * 11/2017 Saadon ..... F41C 23/16
D22/108
9,851,176 B2 * 12/2017 Flagler ..... F41G 11/003
10,082,363 B2 9/2018 Burgess
10,094,635 B2 * 10/2018 Holmes ..... F41C 23/14
10,670,251 B1 * 6/2020 Hawk ..... F21V 23/0414
2004/0107621 A1 * 6/2004 Segalle ..... F41C 23/16
42/71.02
2005/0241206 A1 * 11/2005 Teetzel ..... F41A 23/08
42/72
2006/0096147 A1 * 5/2006 Gussalli Beretta ..... F41C 23/10
42/71.02
2007/0006511 A1 * 1/2007 Casas Salva ..... F41A 35/02
42/85
2007/0256347 A1 * 11/2007 Fitzpatrick ..... F41A 11/02
42/96
2007/0271832 A1 * 11/2007 Griffin ..... F41C 23/16
42/72
2009/0140015 A1 * 6/2009 Faifer ..... F41G 11/003
224/191
2009/0224076 A1 * 9/2009 Altenburger ..... B05B 5/0532
239/526
2010/0139144 A1 * 6/2010 Fitzpatrick ..... F41A 11/02
42/73
2010/0212203 A1 * 8/2010 McGarry ..... F41C 23/14
42/71.02
2010/0229448 A1 * 9/2010 Houde-Walter ..... F41C 23/16
42/72
2011/0107642 A1 * 5/2011 Godard ..... F41C 23/10
42/71.01
2011/0107643 A1 * 5/2011 Fitzpatrick ..... F41C 23/16
42/72
2011/0255270 A1 * 10/2011 Gross ..... F41G 1/36
362/110
2012/0005930 A1 * 1/2012 Cragg ..... F41A 11/02
42/1.06
2012/0055060 A1 * 3/2012 Hines ..... F41C 23/16
42/71.01
2012/0055061 A1 * 3/2012 Hartley ..... F41C 23/16
42/84
2012/0085013 A1 * 4/2012 Cahill ..... F41C 27/00
42/96
2012/0266514 A1 * 10/2012 Michal ..... F41C 27/00
42/90
2013/0036646 A1 * 2/2013 Rubac ..... F41C 23/16
42/90
2013/0305580 A1 * 11/2013 Burress, Jr. ..... F41C 23/22
42/71.01
2014/0196342 A1 * 7/2014 Syrengelas ..... F41C 7/02
42/71.01
2015/0096215 A1 * 4/2015 Somogy ..... F41C 23/16
42/71.01
2015/0345896 A1 * 12/2015 Michal ..... F41C 23/16
42/75.01
2016/0061560 A1 * 3/2016 Saadon ..... F41G 1/35
42/72
2016/0069637 A1 * 3/2016 Kafer ..... F41C 23/16
42/49.1
2016/0091272 A1 * 3/2016 Hines ..... F41A 35/00
42/90
2016/0169610 A1 * 6/2016 Hines ..... F41C 23/16
42/90
2016/0290760 A1 * 10/2016 Jen ..... F41C 23/16
2016/0313086 A1 * 10/2016 Maroney ..... F41C 23/10
2016/0327371 A1 * 11/2016 Teetzel ..... F41C 23/16
2017/0191792 A1 * 7/2017 Holmes ..... F41C 23/14
2017/0234646 A1 * 8/2017 Flagler ..... F41G 11/003
42/71.01
2017/0307327 A1 * 10/2017 Cross ..... F41C 23/12
2018/0112949 A1 * 4/2018 Joros ..... F41C 23/16
2018/0164071 A1 * 6/2018 Burgess ..... F41G 11/003
2018/0321012 A1 * 11/2018 Bentley ..... F41A 35/06
2019/0249969 A1 * 8/2019 Griffith ..... F41C 23/22
2020/0049450 A1 * 2/2020 Willits ..... F41A 3/66
2020/0158464 A1 * 5/2020 Brown ..... B25G 1/102

* cited by examiner

MODULAR WEAPON FOREGRIP

This invention relates to foregrips used on small arms weapons, such as rifles, and in particular, a modular foregrip with interchangeable grip angle components.

BACKGROUND AND SUMMARY OF THE INVENTION

The modern technique for supporting small arms weapons, such as combat rifles and sub-guns places the support hand with the thumb forward or over the top of the handguard covering the barrel and the support forearm extended and aligned with the barrel axis. This technique is commonly referred to as a "beer can" or a "Combat C" grip for shouldered small arms weapons. The "Combat C" grip provides superior weapon support, retention and manipulation for driving the weapon in dynamic shooting environments, such as close quarter combat.

U.S. Pat. No. 10,082,363 discloses a foregrip for small arms weapons equipped with weapon mounted electronic illumination and laser targeting devices. The weapon foregrip of the '363 patent was developed out of the need for a weapon foregrip that allows the user to manipulate the illumination and targeting devices without altering the support hand grip on the weapon. The '363 foregrip allows the user's support hand to support the weapon in a comfortable and efficient "thumb-forward" grip and has an integral switch extension platform that carries the pressure switch for the illumination or targeting device. The forward extending switch platform properly positions the pressure switch under the user's thumb so that the illumination and/or targeting device can be actuated by the user's thumb while maintaining a positive "thumb-forward" grip on the weapon. The '363 foregrip naturally positions the support hand in a positive thumb-forward grip closer to the barrel axis, which helps mitigate felt recoil from the weapon. The exterior contour of the '363 foregrip also provides an integrated hand stop that allows the support hand to drive against the grip body further increasing weapon control and manipulation.

Although an improvement over conventional foregrips, the fixed configurations of the '363 foregrip dictates that the grip be located forward on the handguard so that the support arm is fully extended to comfortably use a thumb-forward grip. When the support arm cannot be fully extended, the thumb-forward grip causes an unnatural ulnar deviation (abduction) of the support hand on the '363 foregrip, which compromises and "opens" the user's grasp on the '363 foregrip. The user's grip opens due to the configuration and fixed angle of the bottom grip face of the '363 foregrip. When the user's grip opens, the support hand moves out of optimum contact with the foregrip. Any compromise in the grip and stability of the weapon diminishes the user ability to effectively shoot and manipulate the weapon.

The weapon foregrip of this invention is an improvement to the weapon foregrip U.S. Pat. No. 10,082,363. The foregrip uses a modular design that includes a grip base and interchangeable angled grip attachments. The interchangeable angled grip attachments have bottom grip faces with differing grip angles, which allows the configuration of the foregrip to be selectively adapted for the particular user and weapon. In each embodiment, the grip base has a grip body and an integral forward extending switch platform, which properly positions a pressure switch under the user's thumb so that the illumination and/or targeting device can be actuated by the user's thumb while maintaining a positive "thumb-forward" grip on the weapon. In certain embodiments, the foregrip has an electronics head, which houses integrated electronic illumination and/or targeting systems. The electronics head is an integral or detachable hollow forward extension of the grip base below the switch platform The electronic head houses the various electronics, power supplies, and internal wiring of a combination of illumination, target designator, video recording and other electronic systems.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
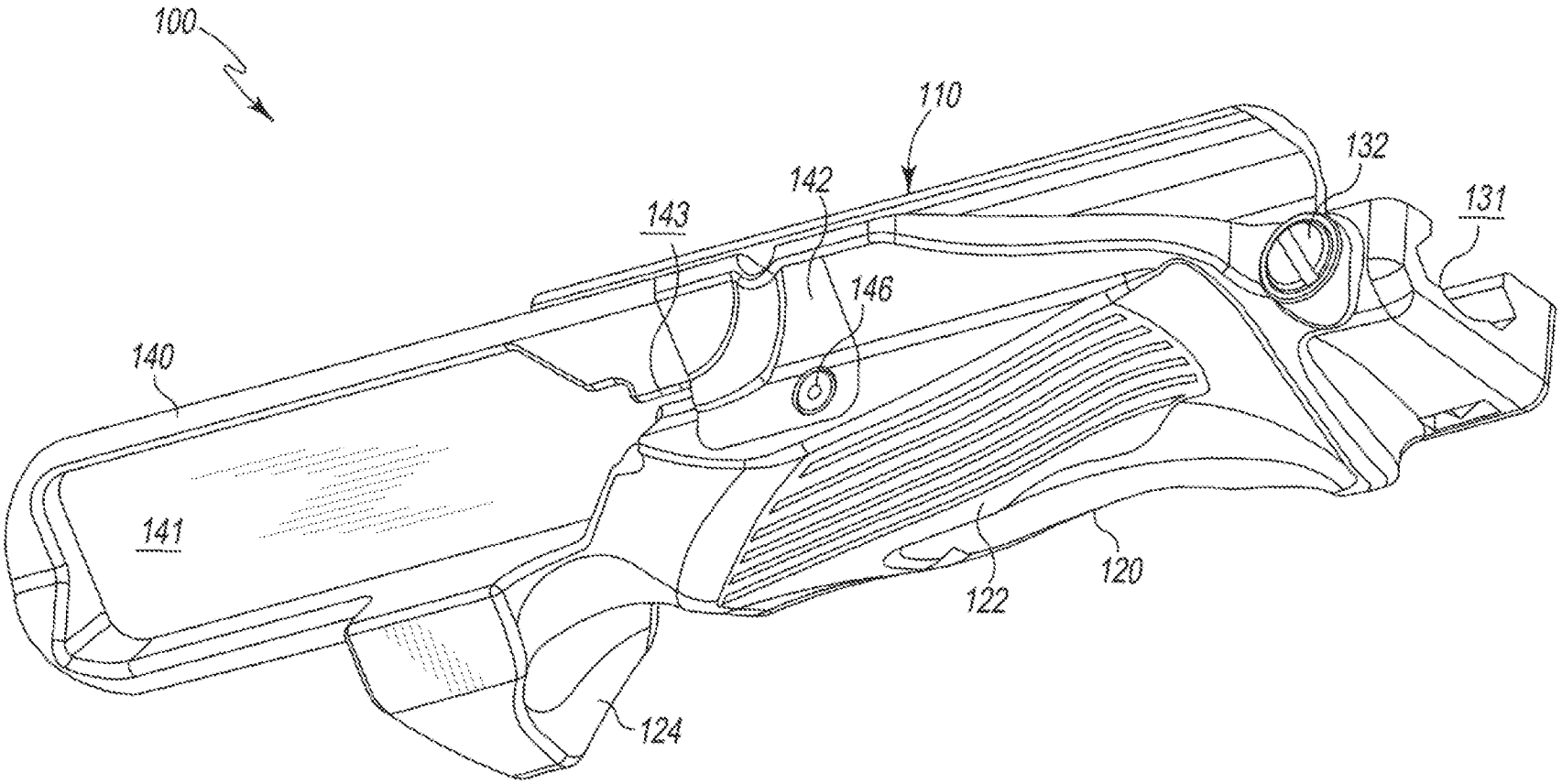
FIG. 1 is a top perspective view of an exemplary embodiment of the weapon foregrip of this invention.
Figure 2:
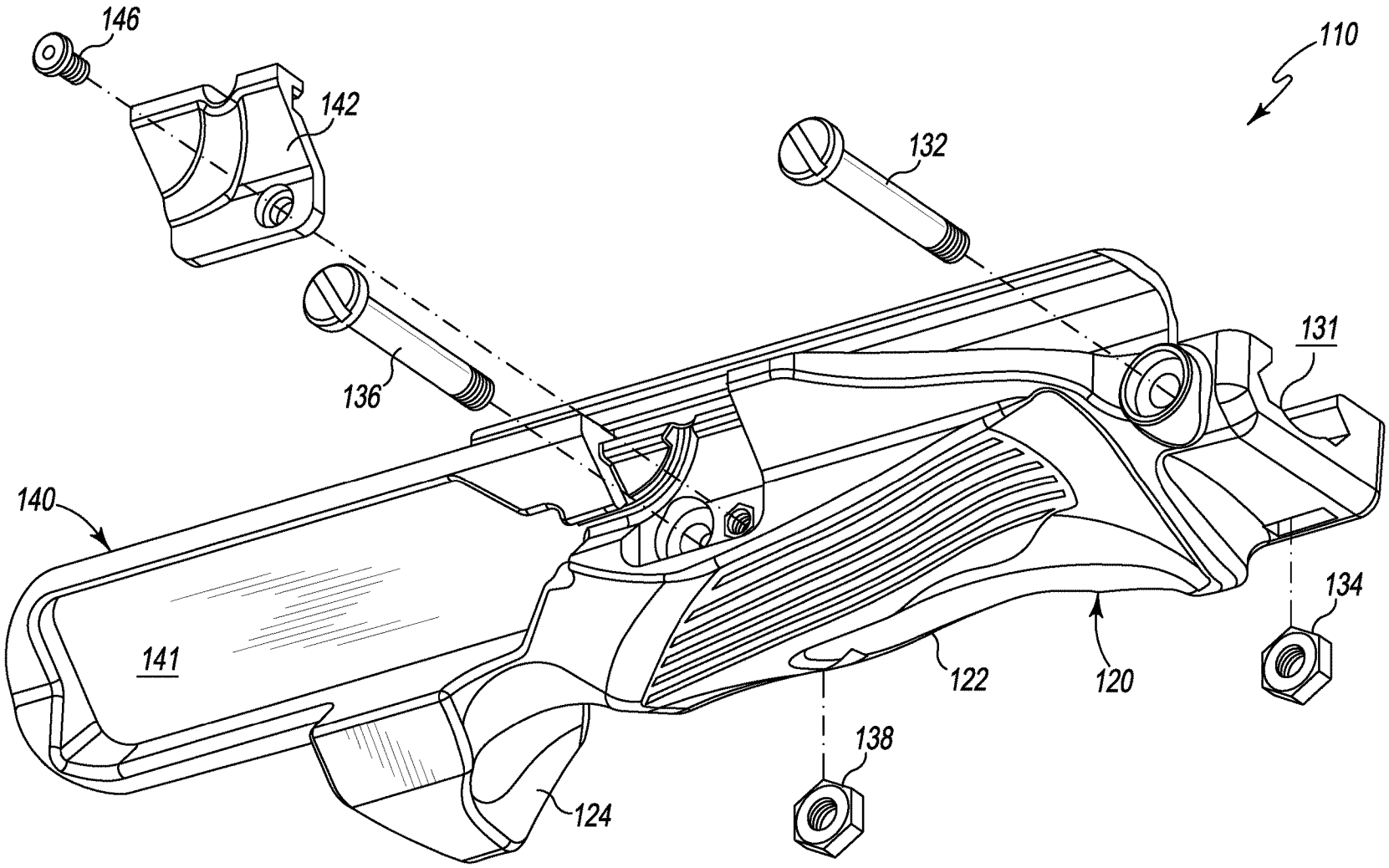
FIG. 2 is an exploded view of the weapon foregrip of FIG. 1.
Figure 3:
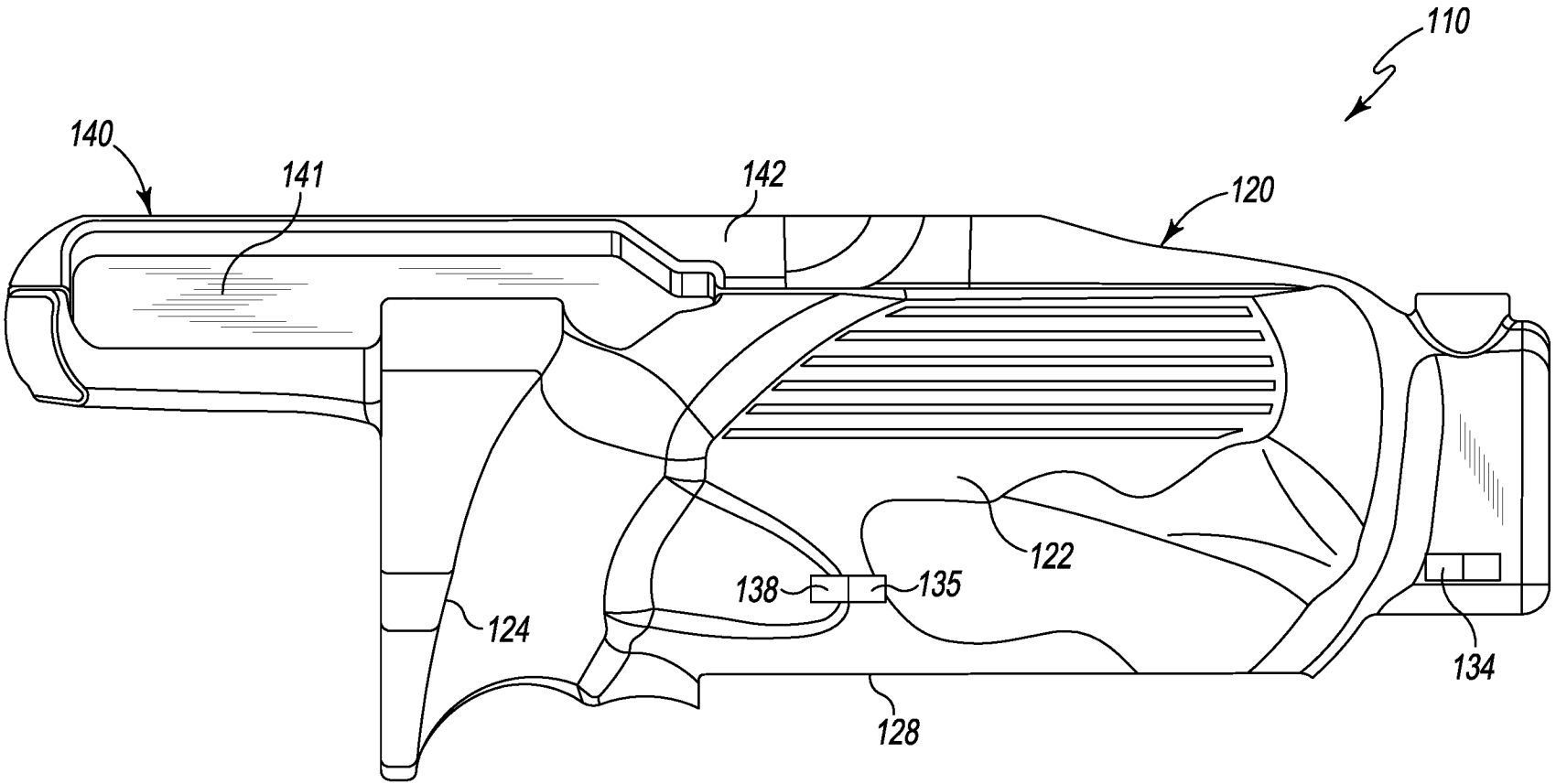
FIG. 3 is a side view of the weapon foregrip of FIG. 1 showing the grip base without a grip attachment.
Figure 4:
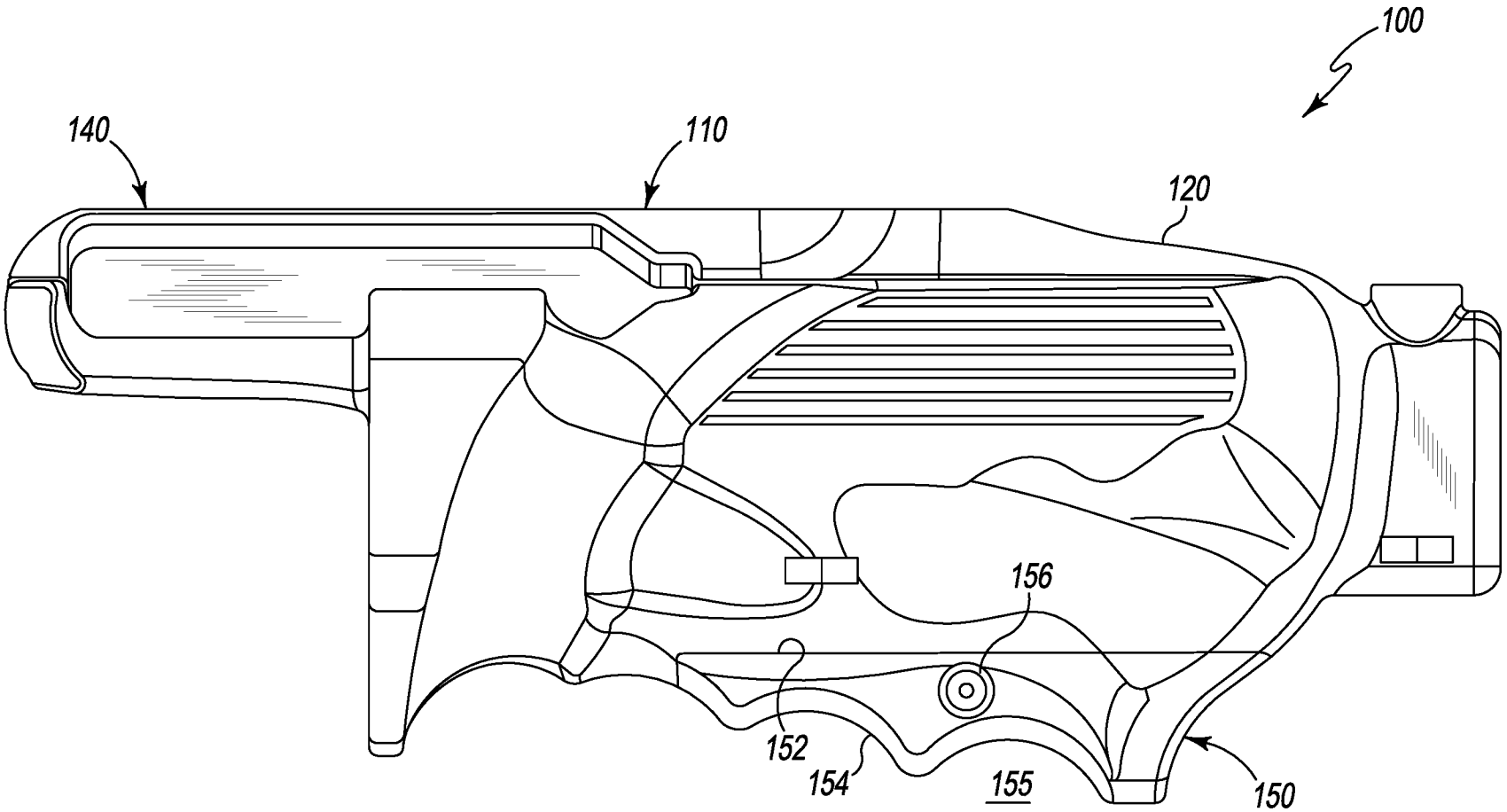
FIG. 4 is a side view of the weapon foregrip of FIG. 1 showing a first embodiment of a grip attachment mounted to the grip base.
Figure 5:
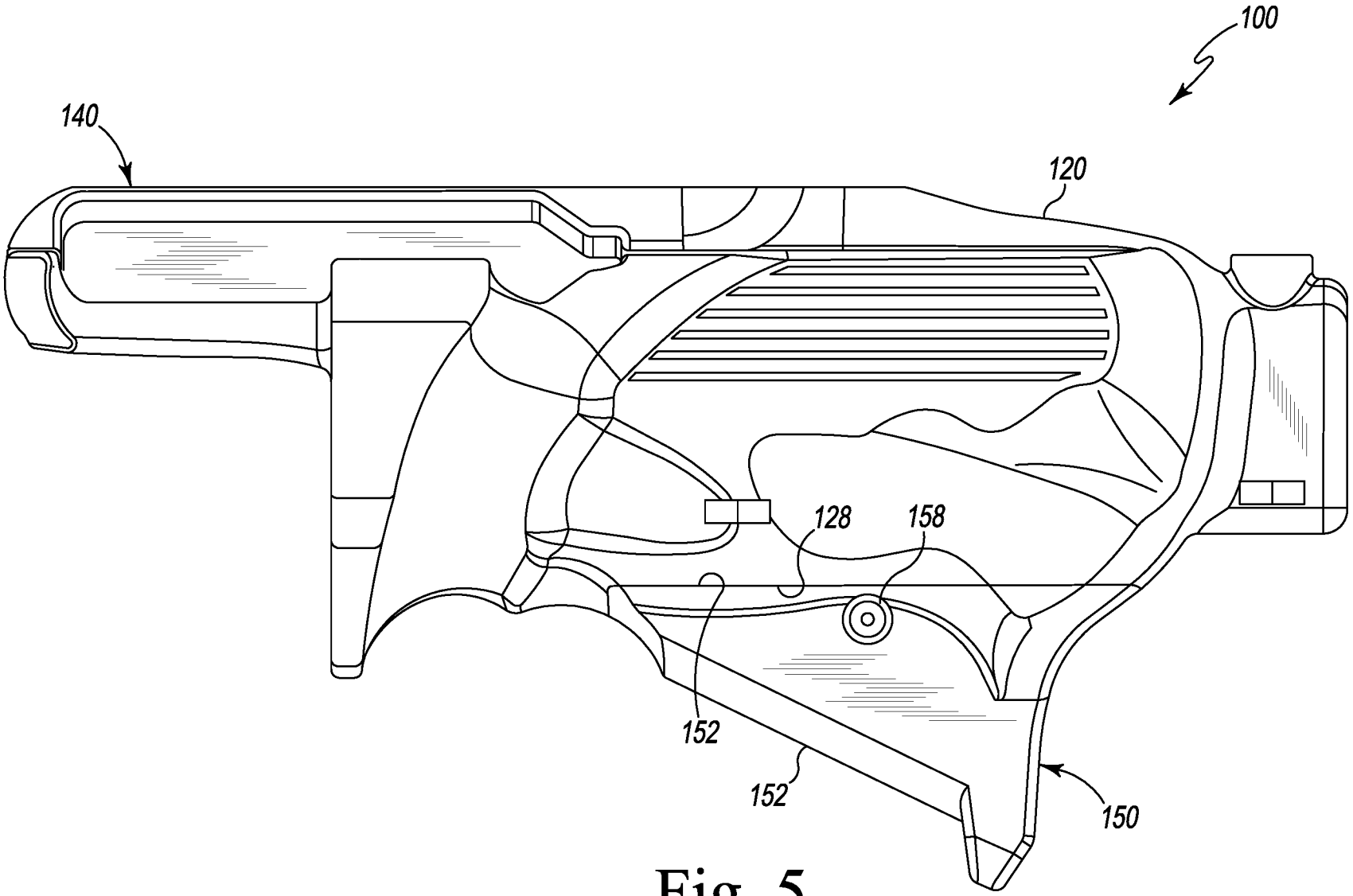
FIG. 5 is a side view of the weapon foregrip of FIG. 1 showing a second embodiment of a grip attachment mounted to the grip base.
Figure 6:
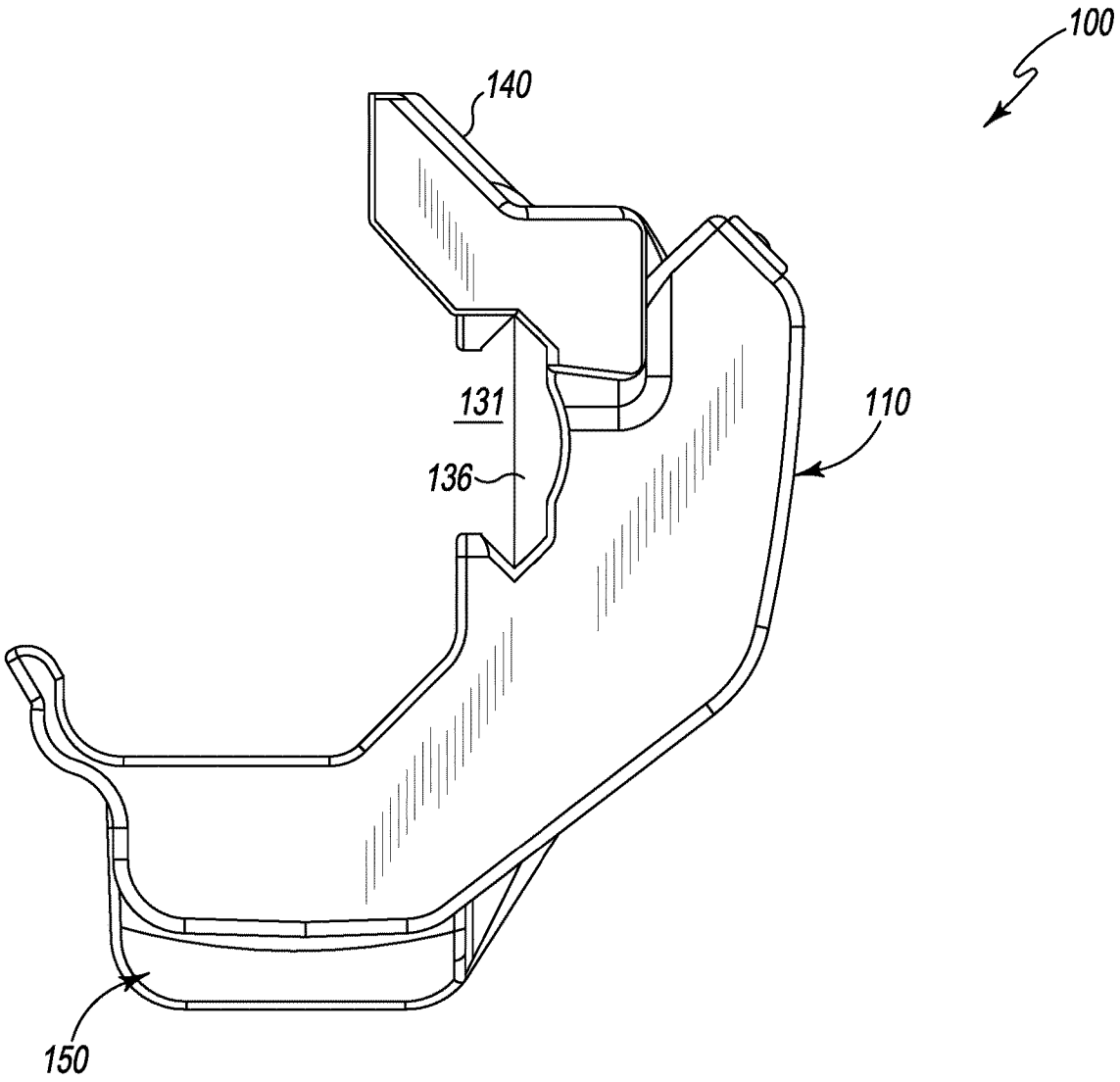
FIG. 6 is a front view of the weapon foregrip of FIG. 4.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The weapon foregrips of this invention are an improvement to the weapon foregrip U.S. Pat. No. 10,082,363 and the teachings therein are incorporated by reference into this invention. The foregrips are used with small arms, such as rifles. In particular, the foregrips are designed for use with M16/AR-15, AK-47 or other shouldered small arms weapons. Each embodiment of the foregrips of this invention employs a modular design with interchangeable grip angle components. The interchangeable grip angle components allow the user's support hand to comfortably support and manipulate the weapon with a "thumb-forward" purchase regardless of the barrel or handguard length. The foregrips are also configured to conveniently position the support hand thumb to easily manipulate activation switches and controls illumination and target devices while maintaining a positive purchase on the foregrip. In additional embodiments, illumination and targeting devices are integrated into the main body of the foregrip.

Each embodiment of the foregrip of this invention is designed to mount directly to the weapon's rail interface system ("RIS"). The rail interface systems, also commonly referred to as rail accessory systems, is a generic term for a system for attaching weapon accessories to small firearms such as pistols, rifles and light machine guns. Common weapon accessories include tactical lights, laser aiming modules, forward hand grips, weapon sights and optics, and bipods. A variety of rail interface systems have been developed for military and civilian application, including Picatinny (MIL-STD-1913), KeyMod and M-Lok®. These rail interface systems are well known in the firearms industry and most weapon accessories are compatible with one or more rail interface system.

Referring now to the drawings, FIGS. 1-6 illustrate an exemplary embodiment of the rifle foregrip, which is designated generally as reference numeral 100. Foregrip 100 includes a grip base 110 and interchangeable angled grip attachments 150 and 160. Grip base 110 and angled grip attachments 150 and 150' are molded or formed from a suitable polymer material, such as a reinforced nylon or poly-urethane composite. The polymer material is selected for strength, durability and heat resistance. Grip base 110 is adapted to be secured to side Picatinny rails (not shown) of a weapon handguard (also not shown), but may be adapted to accommodate any rail interface system, such as KeyMod or M-Lok. Angled grip attachments 150 and 150' are detachably mounted to grip base 110 and provide different grip configurations.

Grip base 110 has a grip body 120 and an integral forward extending switch platform 140. Grip body 120 is configured for a right handed user, but alternative embodiments, may be configured for left handed users, within the teaching of the invention. Grip body 120 is configured to wrap partially around the side and bottom of the weapon handguard. The exterior of grip body 120 is contoured to receive the user's support hand and has a palm swell 122 and a forward hand stop 124. Grip body 120 also has a bottom interface surface 128, which mates with grip attachments 150 and 150'.

The interior of grip body 120 has an arcuate surface and a longitudinal channel 131 that is complementary to a side Picatinny rail of the rifle handguard (not shown). Grip body 120 includes a locking screw 132 that cooperates with a nut 134 to squeeze the opposite sides of the channel 131 toward each other to thereby firmly secure the grip base 110 axially along the Picatinny rail of a hand guard (not shown). To distribute longitudinal loads between grip base and the Picatinny rail, grip body 120 may also comprise additional screws 136 that extend through an aligned hole in grip body 120 and one of the transverse grooves of the Picatinny rail to prevent longitudinal slippage between the grip and rail. Screw 136 is threaded into a second nut 138 seated within a slot 135 in grip body 120, which further secures grip base 110 to the Picatinny rail. In alternative embodiments, the inner surface of grip body 120 may be configured to mount to other rail interfaces systems, such as M-Lok and KeyMod style rails within the teachings of this invention. In such alternative embodiments, complementary M-Lok and KeyMod fasteners are used to secure grip base 110 to the rail interface system of the rifle handguard. Such fasteners and connections are well known in the industry.

Switch platform 140 extends forward and above hand stop 124 of grip body 120. Switch platform 140 has a recessed interior 141 for receiving a conventional pressure switch (not shown) of the type used to activate weapon mounted lights and target designators. Grip body 120 also has a recessed wire channel 143 for receiving the pressure switch lead wire (not shown). The lead wire connects the pressure switch to the electronic illumination or targeting devices, whether a light, laser, or other electronic device. Wire channel 143 extends from switch recess 141 and terminates over the top edge of grip body 110. A capture plate 142 is detachably mounted to grip body 120 to hold the switch lead wire within wire channel 143. Capture plate 142 is held to grip body 120 by a screw fastener 146.

Angle grip attachments 150 and 150' are separate components that are interchangeably mounted to grip base 110. Each grip attachment 150 and 150' has a body with a top interface 152 and an angled bottom grip face 154. Angled grip face 154 has contoured lateral finger grooves 155. Top interface surface 152 mates with the bottom surface of grip body 120 and is secured by a pin or fastener 156 that extends through aligned bores in the attachment and grip body. In certain embodiments, top interface surface 152 and bottom interface surface 128 may include a dove-tail groove interface that mates with the angled grip attachments. Both grip attachments are similar in construction and function, but vary in the angle of the grip face 154. The different angles of the grip faces 154 allow the user to select the most comfortable support hand position for the given handguard length. Although two angled grip attachments are illustrated and described herein, other angled grip attachments of similar construction and configuration with differing grip face angles are contemplated within the teachings of this invention.

The grip attachment fitted to grip base 110 is selected so that the support hand remains comfortable and in full contact with angled grip face 154. Typically, positioning foregrip 100 further from the weapon receiver allows the support arm to be more fully extended and more horizontal grip face angle tends to be more comfortable for the user. Positioning foregrip 100 closer to the rifle receiver prevents the support arm from fully extending and "opening" the support hand's grip on the foregrip 100 while maintaining a thumbs-forward grip. As the support arm bends and the support hand grip opens, a more vertical grip face angle (attachment 150') tends to be more comfortable for the user.

In use, foregrip 100 is mounted to the rail interface at the desired position along the rifle handguard. The user's support hand grasps grip 100 with the palm swell 122 resting in the user's palm, the web of the hand between the thumb and index finger abuts hand stop 124 and the fingers extending tranversely across the angled bottom surface of grip attachment 150. The support hand thumb extends forward and rests over switch platform 140. Grasped in this manner, grip 100 properly positions the user's thumb to readily activate by the pressure pad carried on the switch platform 140 without altering the user's purchase on grip 100.

Figure 7:
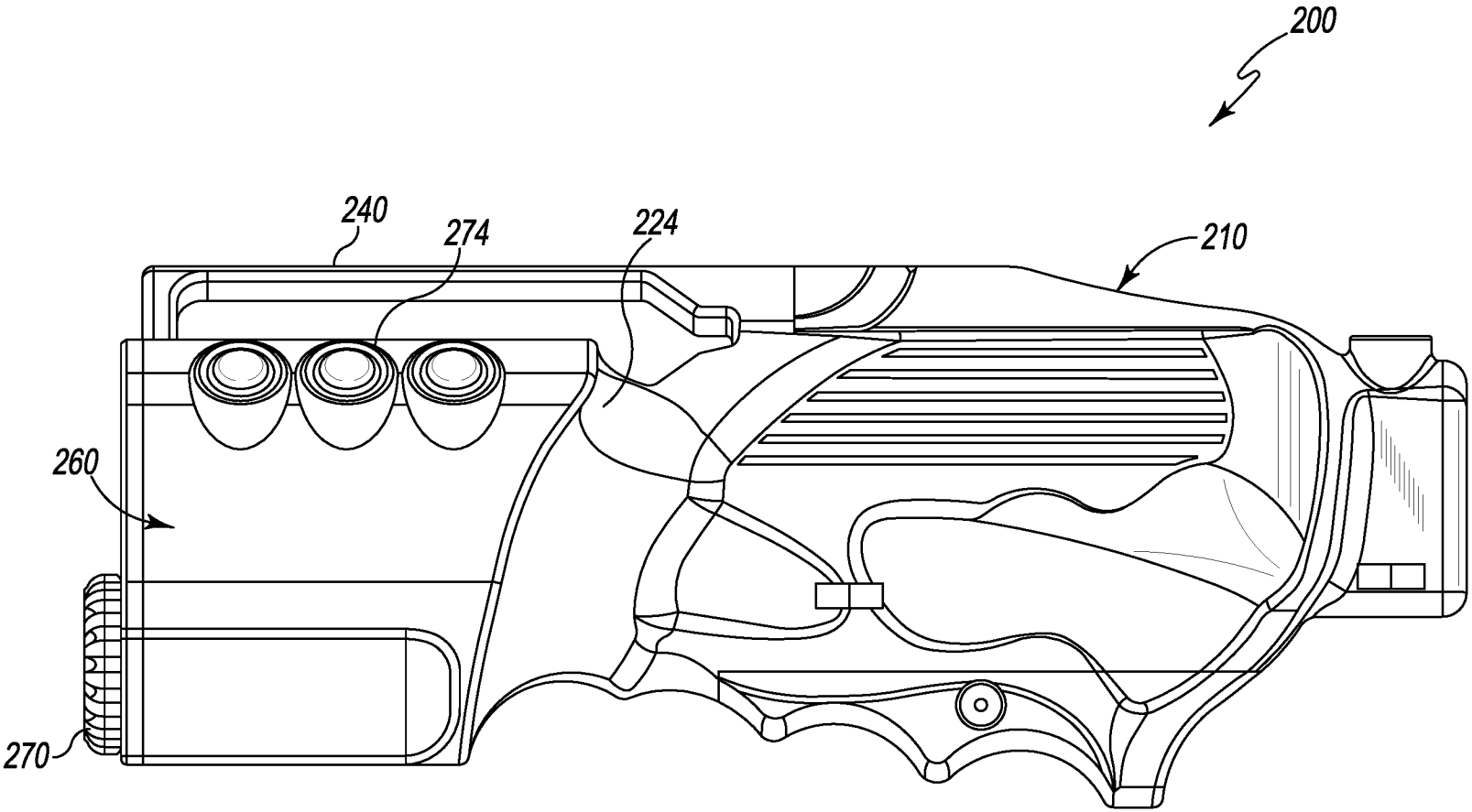
FIG. 7 is a side view of a second exemplary embodiment of the weapon foregrip of this invention.
Figure 8:
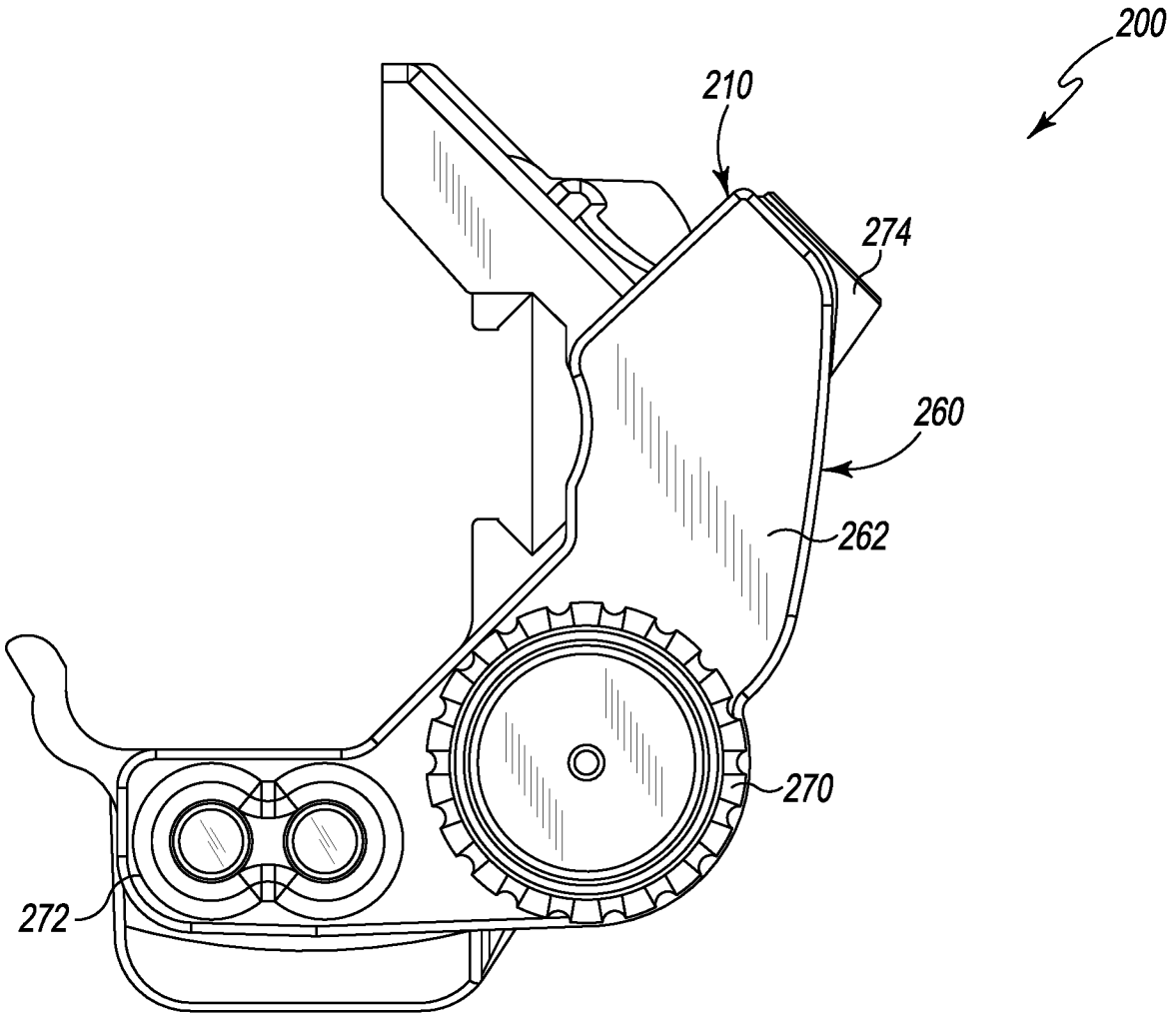
FIG. 8 is a front view of the weapon foregrip of FIG. 7.
Figure 9:
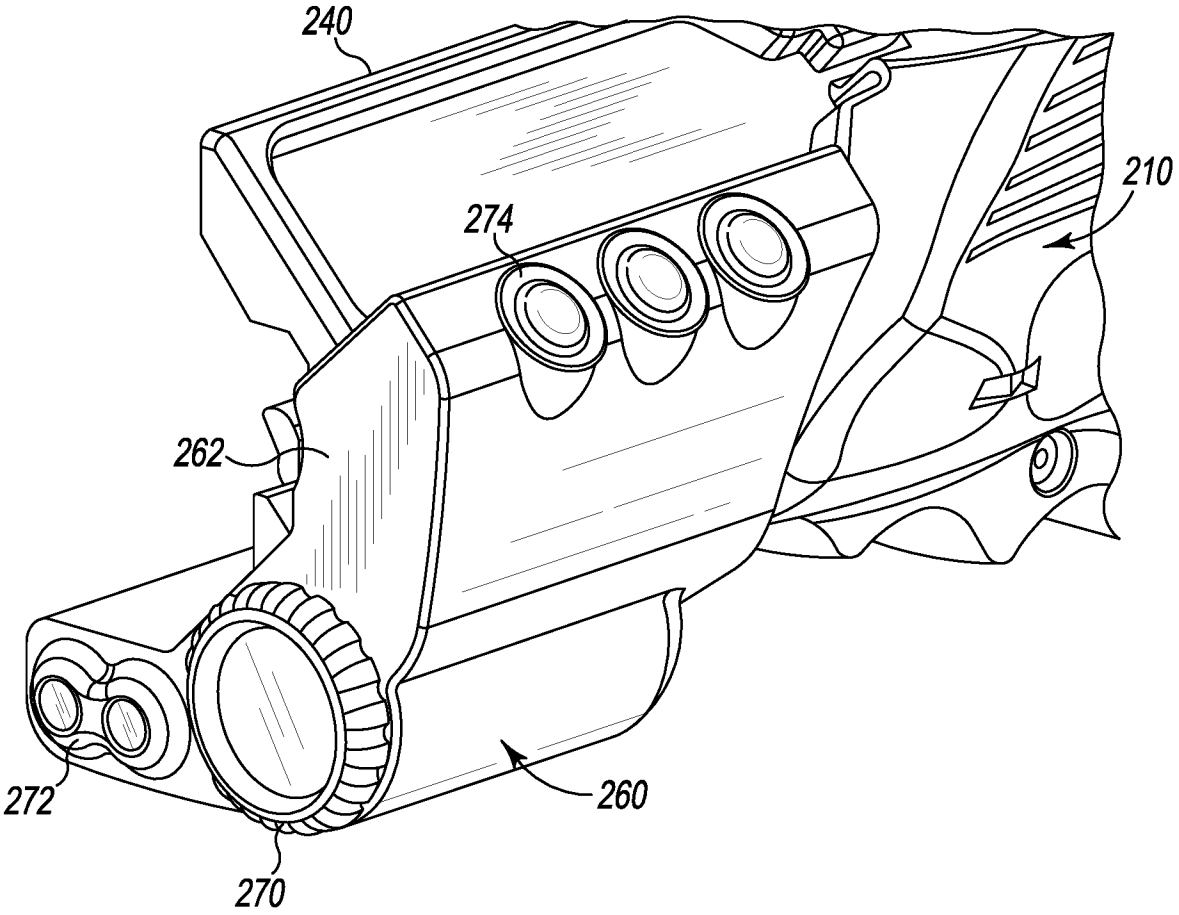
FIG. 9 is a partial front perspective view of the weapon foregrip of FIG. 7.
Figure 10:
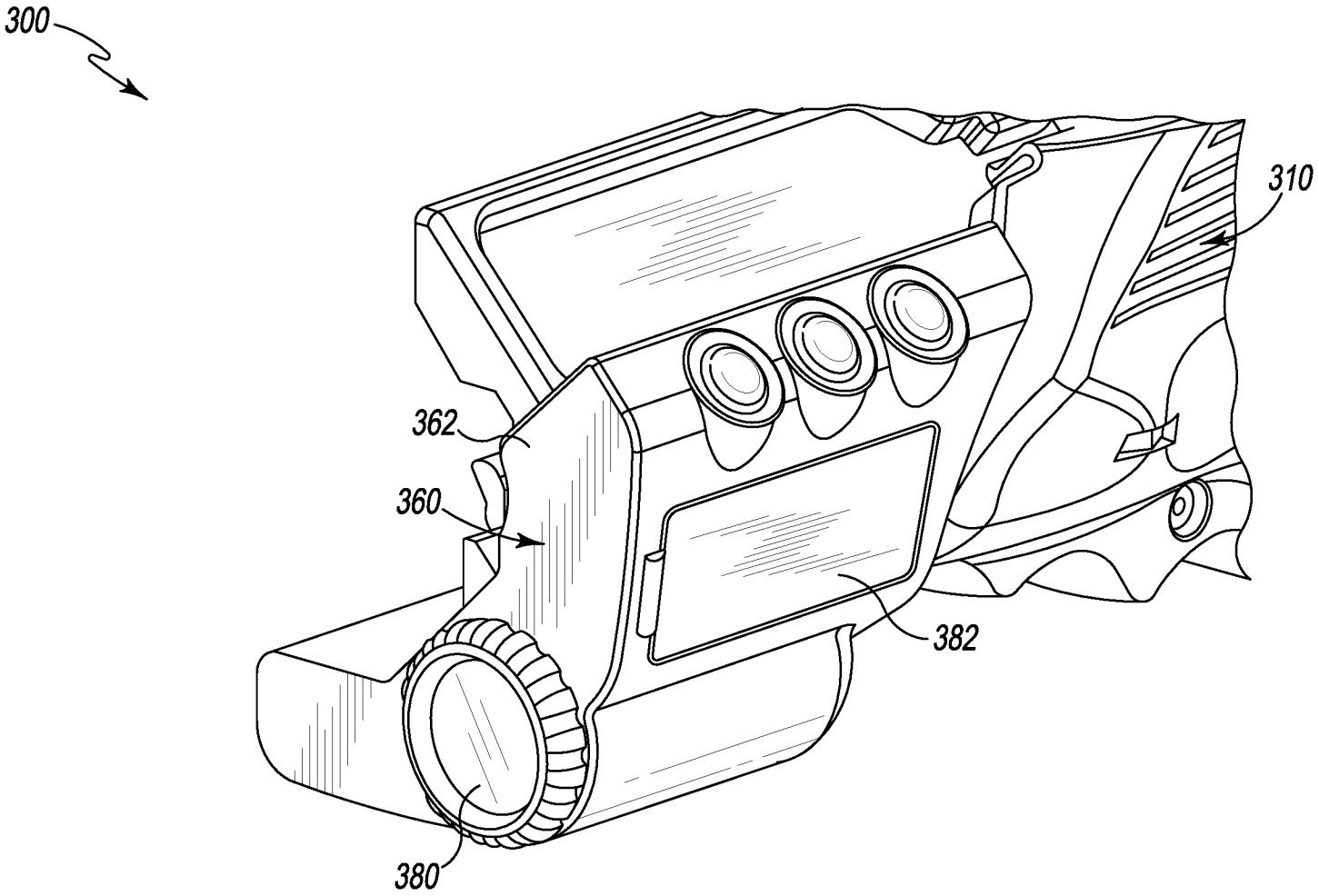
FIG. 10 is a partial front perspective view of a third exemplary embodiment of the weapon foregrip of this invention, showing the monitor screen closed.
Figure 11:
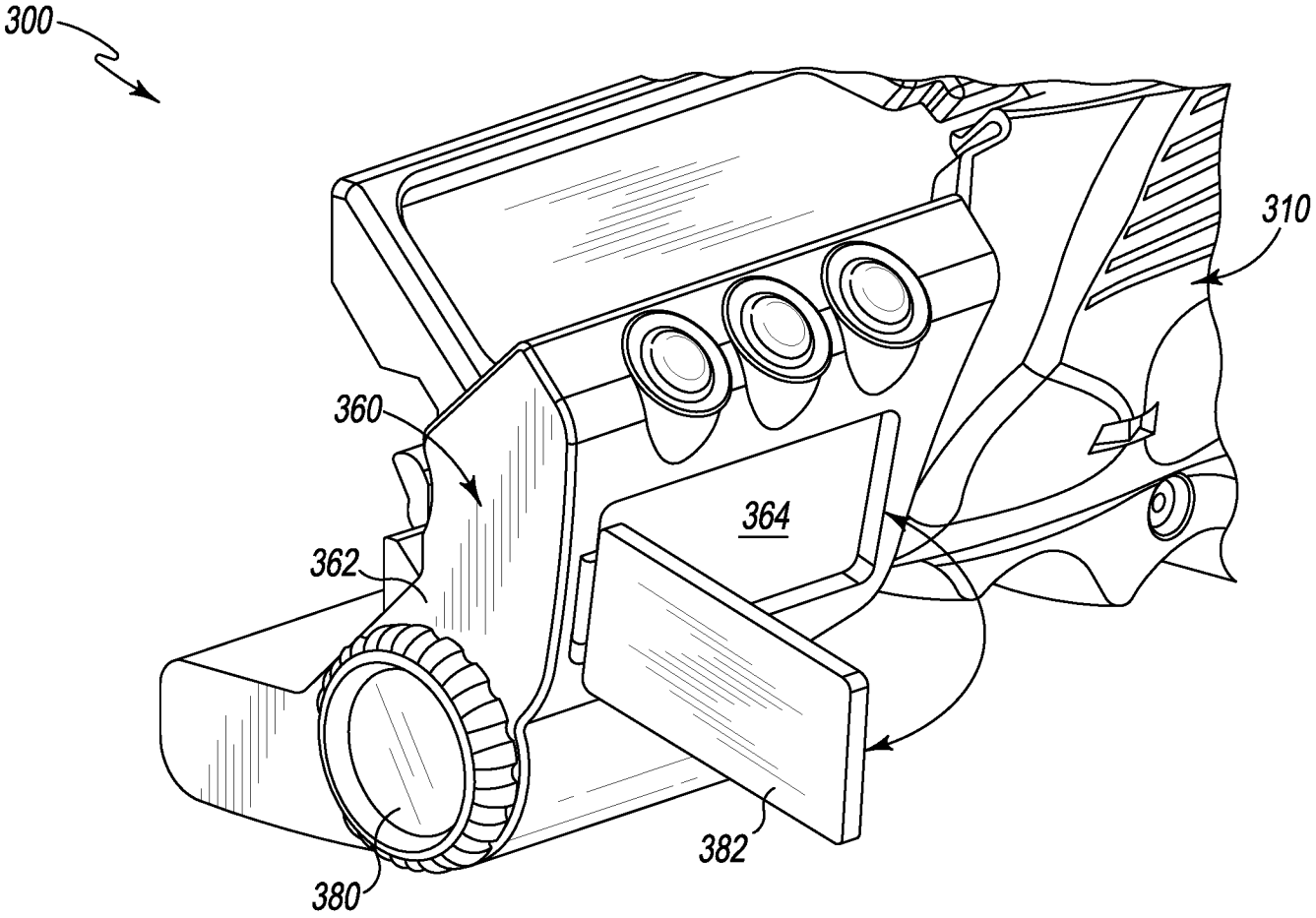
FIG. 11 is another partial front perspective view of the weapon foregrip of FIG. 10, showing the monitor screen open.
Figure 12:
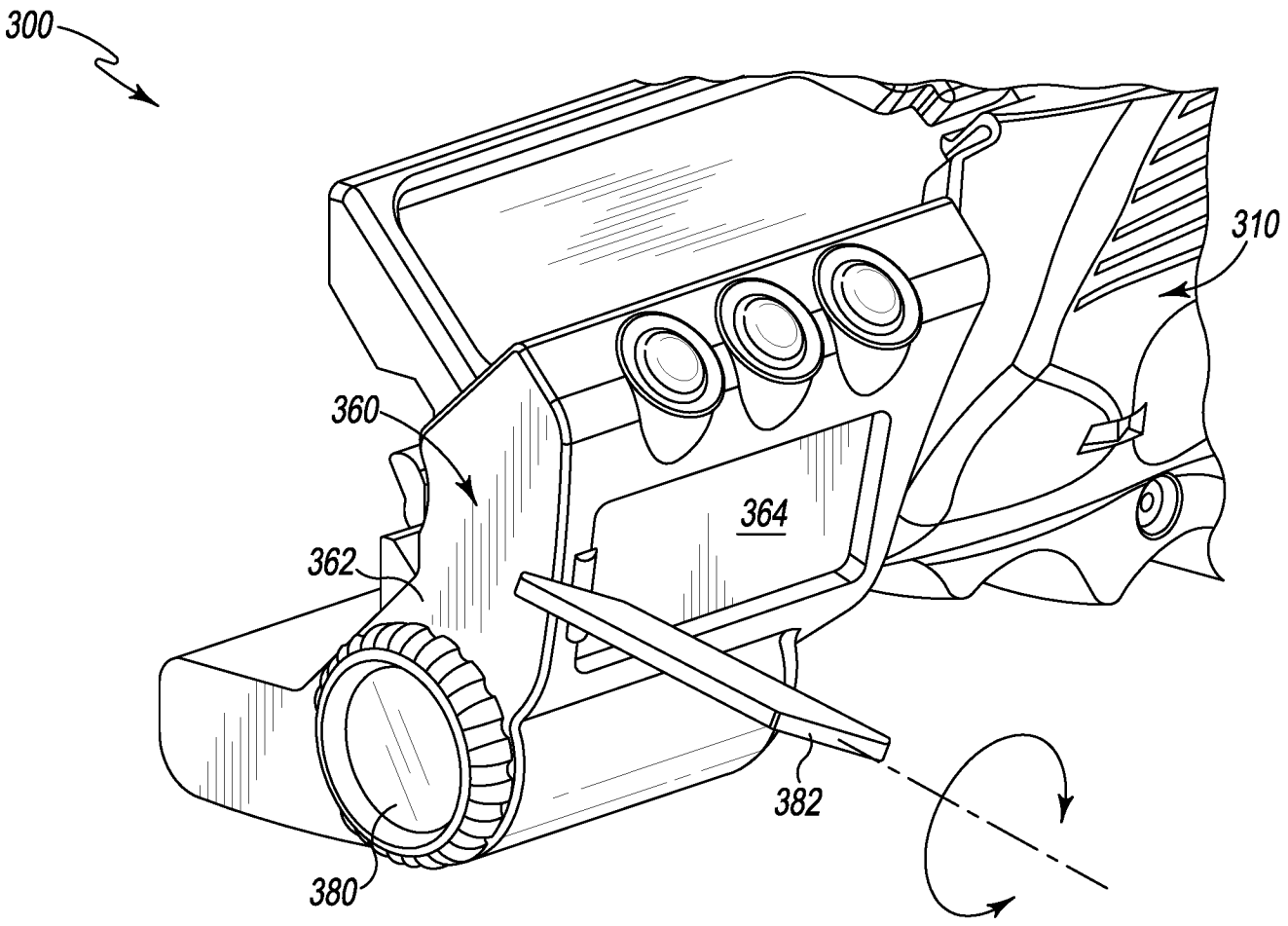
FIG. 12 is another partial front perspective view of the weapon foregrip of FIG. 10, showing the monitor screen rotating.
Figure 13:
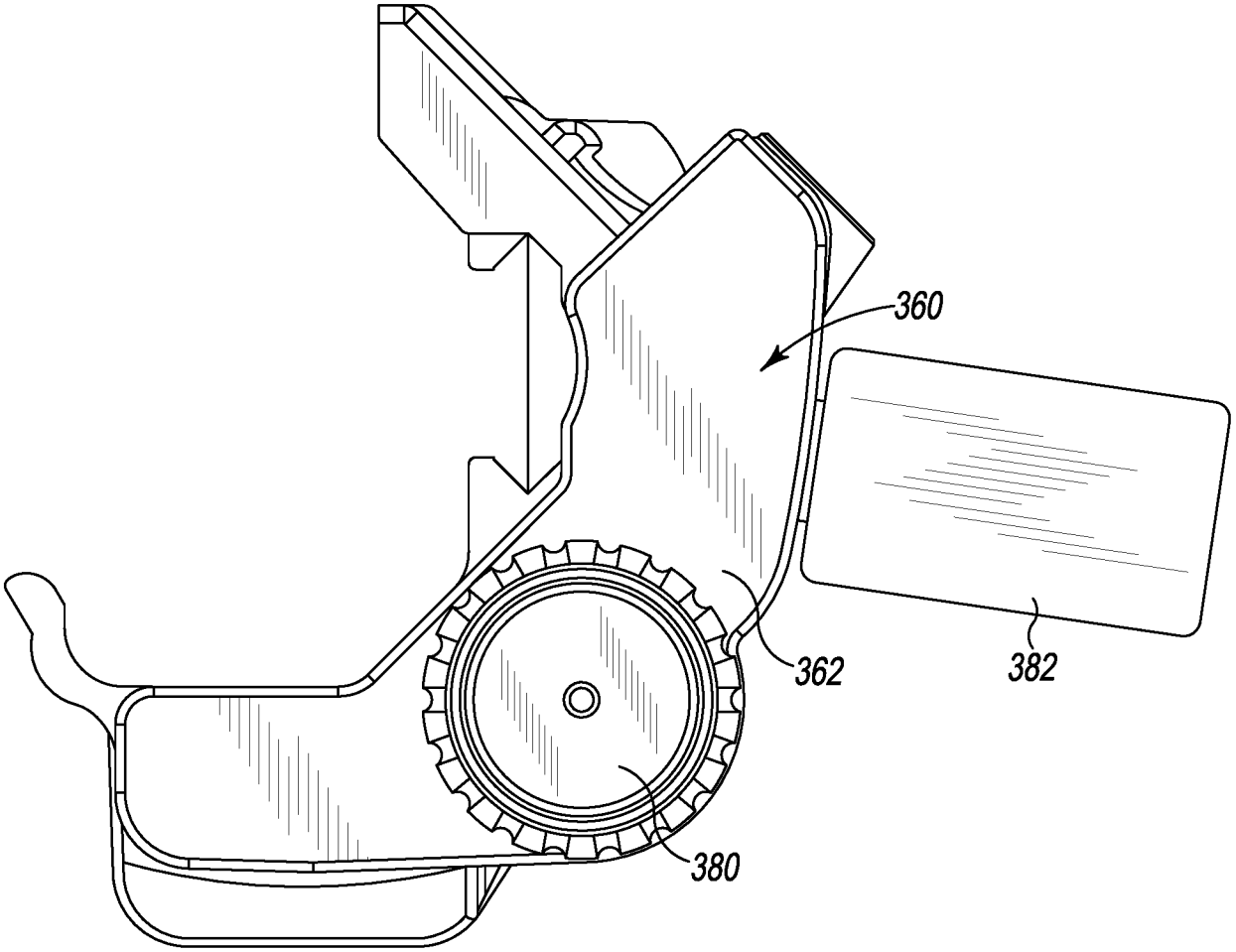
FIG. 13 is a front view of the weapon foregrip of FIG. 11.

FIGS. 7-9 illustrate a second exemplary embodiment of the grip of this invention, which is designated generally as reference numeral 200. Foregrip 200 is similar in design and function to foregrip 100, but has an electronic head 260 integrated in grip base 210, which houses integrated electronic illumination and/or targeting electronic. Electronics head 260 allows for the integration of various weapon mounted electronic devices into grip 200. Electronics head 260 is an integral hollow forward extension from hand stop 224 below switch platform 240. Electronic head 260 has a flat front face 262 and multiple (three) raised activation buttons 264 horizontally aligned beneath the switch platform 240. Electronic head 260 has a hollow interior that houses the various electronics, power supplies, and internal wiring. Typically, the power supplies are batteries stored in the battery compartments (not shown) disposed within electronic head 260 or elsewhere within grip base 210. In alternative embodiments, battery compartments may also be disposed within the angled grip attachments. As shown, a conventional light head 270 and IR illuminator/designator head 272 extend from front face 262. Light head 270 and IR illuminator/designator head 272 are of conventional design and function of the type well known in the industry. Light head 270 provides a white light illumination and IR illuminator/designator head 272 provide inferred illuminator and laser targeting for night vision operations. Light head 270 and IR illuminator/designator head 272 are internally wired to raised control button 274 and/or an optional pressure switch pad (not shown). Internal electronics (not shown) allow control button 274 and the optional pressure pad to be user programmed to selectively control both light head 270 and IR illuminator/designator 272. The location of control button 274 position directly below switch platform 240, allows all of the control buttons 274 and the optional pressure pad to be activated by the support hand thumb.

FIGS. 10-13 illustrate a third exemplary embodiment of the weapon foregrip of this invention, which is designated generally as reference numeral 300. Weapon foregrip 300 is identical in design and function to foregrip 200, except that electronic head 360 houses an integrated video recording system and monitor. Weapon mounted video recording systems are well known and readily used to record tactical engagements from the operator's perspective. Typically, such video recording systems are separate components and devices mounted to weapon systems. Weapon foregrip 300 integrates the video recording components and control directly into the grip base 310. As shown, weapon foregrip 300 includes a video lens 380 extending from the front face 362 of grip base 310 and a video monitor 382 that pivots and folds from a recess 264 in the side of the electronic head 360 between a closed and open position. Again, electronic head 360 has a hollow interior that houses the various electronics, power supplies, and internal wiring.

Figure 14:
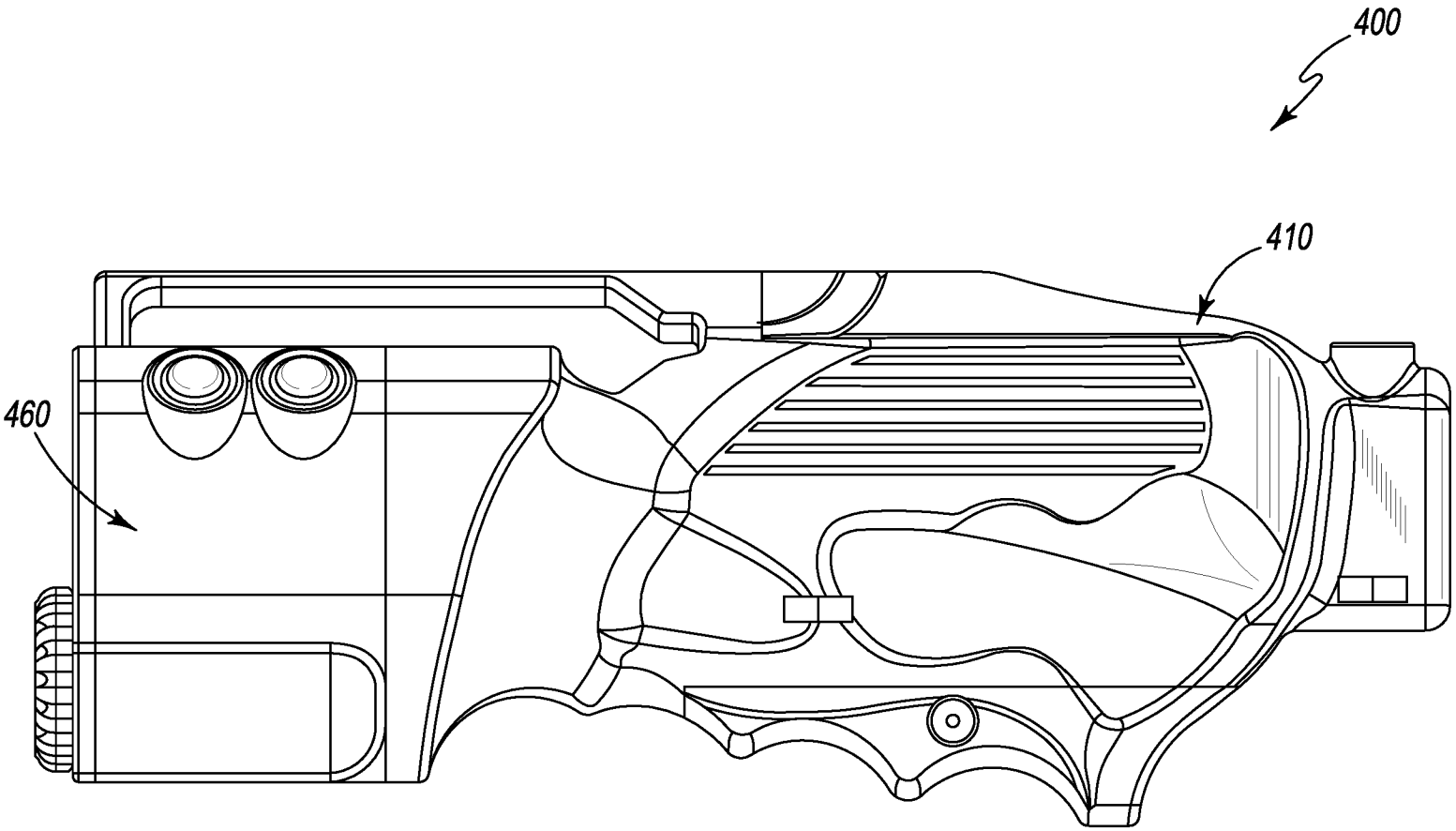
FIG. 14 is a side view of a fourth exemplary embodiment of the weapon foregrip of this invention.
Figure 15:
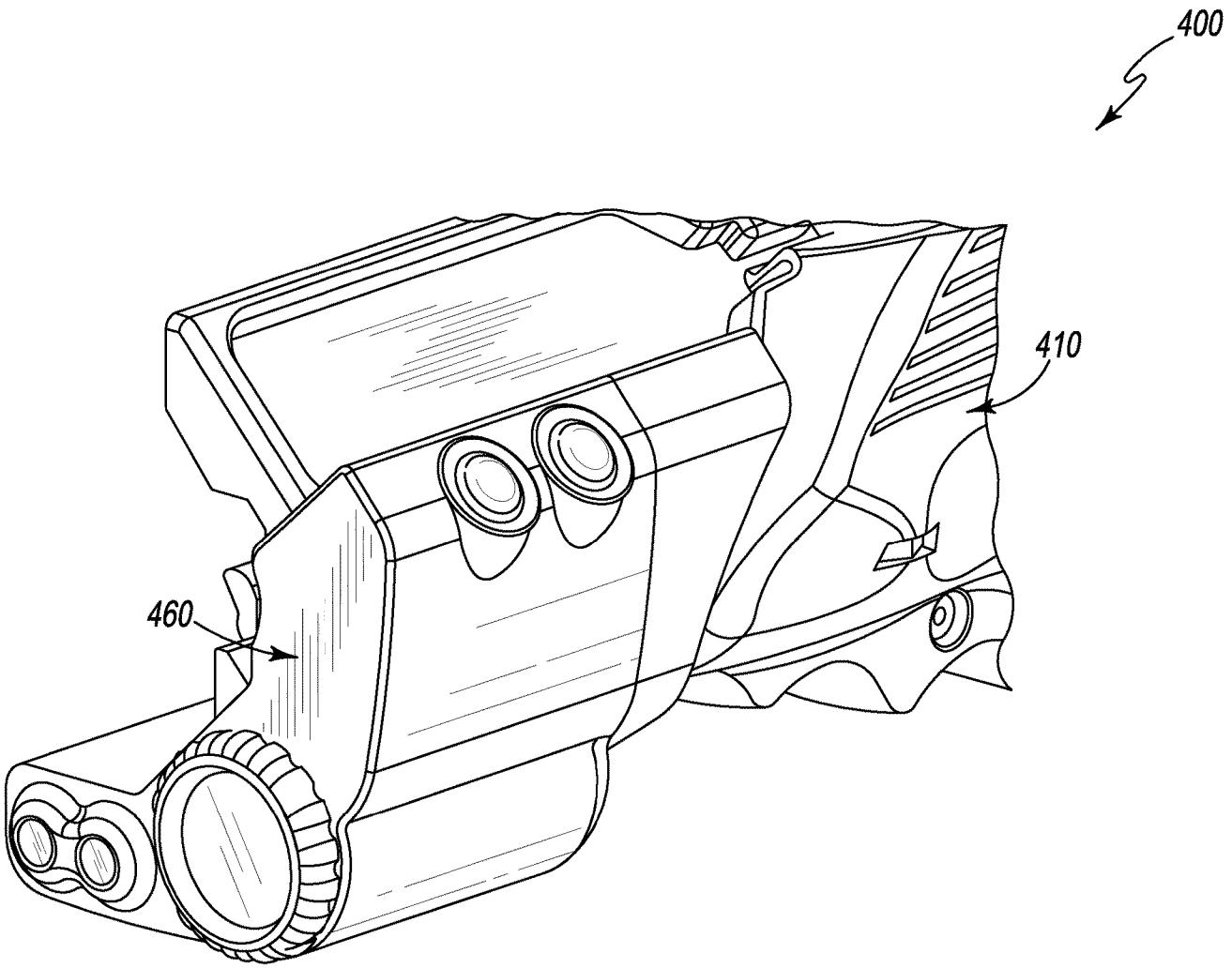
FIG. 15 is a partial perspective view of the weapon foregrip of FIG. 14.
Figure 16:
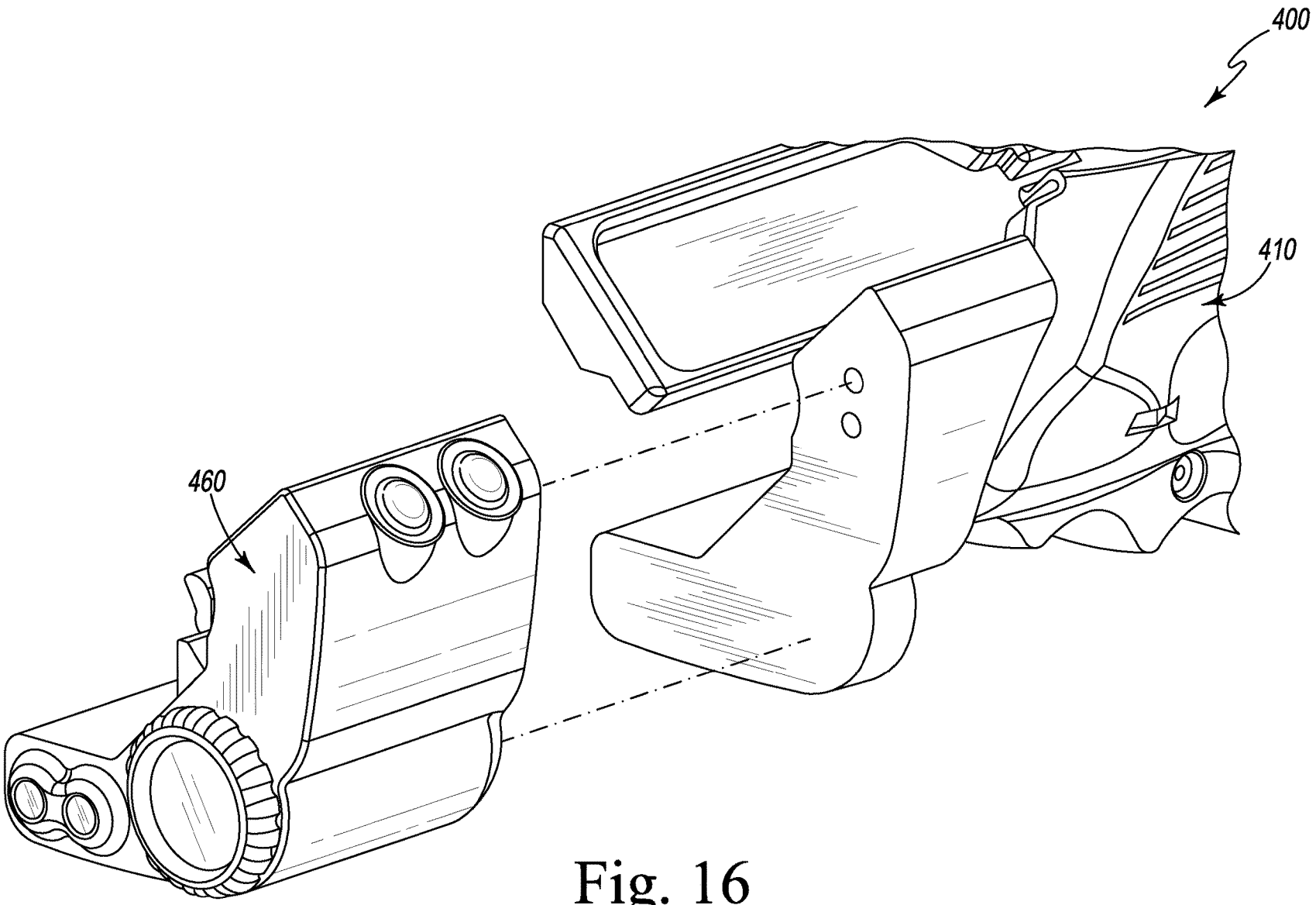
FIG. 16 is an exploded view of the weapon foregrip of FIG. 14.

FIGS. 14-16 illustrate a fourth exemplary embodiment of the foregrip of this invention, which is designated generally as reference numeral 400. Foregrip 400 is identical in design and function to foregrip 200, except that electronic head 460 is a detachable component fitted to grip base 410. Detachable electronic head 460 allows different combinations of electronic devices to be interchangeably fitted to grip base 410. Each electronic head 460 may incorporate a different combination of illumination, target designators, video recording or other weapon mounted systems, which can be readily fitted to grip base 410. The interface connection between electronic head 460 and grip base 410 may take any suitable form, which allows a quick, sturdy, positive engagement between the components without the use of tools. The added modularity of foregrip 400 further facilitates the adaptability of the foregrip for particular users and applications.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A weapon foregrip adapted to mount to a weapon having a handguard covering the weapon barrel; the weapon foregrip comprising:

a grip base mountable to the handguard; and a grip attachment interchangeably mounted to the grip base, the grip base and the grip attachment being adapted and configured such that, when operating the weapon, a person's palm can extend adjacent a side of the handguard with the grip base therebetween and the person's fingers can extend across and below the bottom of the handguard with the grip attachment therebetween, the grip base includes a grip body and an integral switch platform, the switch platform adapted to carry an electronic pressure switch configured and adapted to actuate an electrical rifle accessory, the switch platform extends forward longitudinally beyond the muzzle end of the grip body, where, when operating the rifle and holding the handguard, the pressure switch can be actuated via a person's thumb while the person's palm remains extended adjacent the one of the opposite sides of the handguard body and the person's fingers remain extended across and below the grip attachment, the grip body has a bottom interface surface, the grip attachment having a top interface surface adapted to detachably engage the bottom interface surface of the grip body to secure the grip attachment to the grip base, the grip attachment also having a bottom grip face angled with respect to the switch platform top interface surface and contoured to receive the fingers of the user's support hand.

2. The weapon foregrip of claim 1 wherein the grip body also having an integral hand stop portion protruding radially from the grip body first end.

3. The weapon foregrip of claim 2 wherein the switch platform extends forward of the hand stop portion.

4. The weapon foregrip of claim 1 wherein the grip body also having a contoured palm swell portion.

5. The weapon foregrip of claim 2 wherein the grip base includes a electronic head extending forward from the hand stop portion adjacent the switch platform.

6. The weapon foregrip of claim 5 wherein the electronic head houses select electronic systems and components operated via the pressure switch.

7. The weapon foregrip of claim 6 wherein the electronic head is integral to the grip body.

8. The weapon foregrip of claim 6 wherein the electronic head is detachably connected to the grip body.

9. The weapon foregrip of claim 6 wherein the select electronic systems and components includes a weapon illumination component.

10. The weapon foregrip of claim 6 wherein the select electronic systems and components includes a laser target designator.

11. The weapon foregrip of claim 6 wherein the select electronic systems and components includes a video components.

12. The foregrip of claim 6 wherein the select electronic systems and components includes weapon illumination.

13. The weapon foregrip of claim 6 wherein the electronic head has a front face and a side thereof.

14. The weapon foregrip of claim 13 wherein the electronic head side includes external controls components operatively connected to the select electronic systems and components to actuate the select electronic systems and components.

15. The weapon foregrip of claim 13 wherein the select electronic systems include an illumination head protruding from the electronic head front face.

16. The weapon foregrip of claim 13 wherein the select electronic systems include a target designator head protruding from the electronic head front face.

17. The weapon foregrip of claim 13 wherein the select electronic systems includes a power source disposed within the electronic head.

18. The weapon foregrip of claim 9 wherein the electronic head side includes external controls components operatively connected to the select electronic systems and components to actuate the select electronic systems and components.

19. The weapon foregrip of claim 13 wherein the electronic head includes a monitor screen pivotally mounted to the electronic head side for movement between a stowed position overlying the electronic head side and an operational position extending from the electronic head side.

20. The weapon foregrip of claim 1 and a second grip attachment interchangeably adapted to replace the first grip attachment mounted to the grip base, the second grip attachment having a bottom grip face angled with respect to the switch platform at a different angular orientation than that of the first grip attachment.

* * * * *